US008789213B2

(12) United States Patent
Abunameh

(10) Patent No.: US 8,789,213 B2
(45) Date of Patent: Jul. 29, 2014

(54) SELF-VENTILATING TOILET

(76) Inventor: Hani A. Abunameh, Amman (JO)

( * ) Notice: Subject to any disclaimer, the term of this patent is extended or adjusted under 35 U.S.C. 154(b) by 509 days.

(21) Appl. No.: 13/199,354

(22) Filed: Aug. 26, 2011

(65) Prior Publication Data

US 2012/0054950 A1 Mar. 8, 2012

Related U.S. Application Data

(63) Continuation-in-part of application No. 11/893,757, filed on Aug. 17, 2007, now abandoned.

(51) Int. Cl.
*E03D 9/04* (2006.01)

(52) U.S. Cl.
USPC ..... 4/213; 4/216

(58) Field of Classification Search
USPC ..... 4/306, 347, 348, 352, 209 R, 213, 216; 417/423.14, 423.15
See application file for complete search history.

(56) References Cited

U.S. PATENT DOCUMENTS

| | | | | |
|---|---|---|---|---|
| 3,273,170 | A | 9/1966 | Wheeler | 4/348 |
| 5,704,074 | A | 1/1998 | Baldea | |
| 5,906,009 | A | 5/1999 | Sakar | 4/216 |
| 6,018,824 | A | 2/2000 | Pearson | 4/213 |
| 6,233,750 | B1 | 5/2001 | Donald et al. | 4/213 |
| 6,378,832 | B1 | 4/2002 | Li et al. | 248/637 |
| 6,499,150 | B1 | 12/2002 | Thompson | |
| 6,550,072 | B1 | 4/2003 | Ware | |
| 6,588,025 | B1 | 7/2003 | Helmolt | 4/213 |
| 6,760,928 | B1 | 7/2004 | Rodriguez | 4/217 |
| 6,772,449 | B1 | 8/2004 | Wolfe | |
| 6,795,980 | B1 | 9/2004 | Ries | |
| 6,948,192 | B2 | 9/2005 | Hipponsteel | |
| 7,103,925 | B2 | 9/2006 | Toth | |
| 2002/0002735 | A1 | 1/2002 | Moon | 4/213 |
| 2005/0155140 | A1 | 7/2005 | Zulu | 4/213 |
| 2006/0096013 | A1 | 5/2006 | Dang | |
| 2007/0240250 | A1 | 10/2007 | Foerster et al. | 4/213 |

FOREIGN PATENT DOCUMENTS

| | | |
|---|---|---|
| JP | 2002004382 | 1/2002 |
| JP | 2002047715 | 2/2002 |
| JP | 2003096874 | 4/2003 |
| JP | 2004209192 | 7/2004 |
| JP | 2005163512 | 6/2005 |
| JP | 2006144519 | 6/2006 |
| JP | 2006152553 | 6/2006 |

*Primary Examiner* — Gregory Huson
*Assistant Examiner* — Janie Christiansen
(74) *Attorney, Agent, or Firm* — Abelman, Frayne & Schwab

(57) ABSTRACT

A standard fitting toilet commode made with a hardly-noticeable integrated elongated vertical auxiliary chamber located below and behind the seat. The chamber is with a plugged external top opening at the toilet bowl's rear rim behind the seat, and another internal upper side opening connecting with the commode's drain above and downstream of the water siphon. For optional conversion into a self-ventilating toilet, a compact electric fan unit is retrofitted behind the toilet seat and secured thereto at the seat anchor holes. A single intake nozzle sucks toilet bowl gases from under the rear of toilet seat, through the electric fan, and out into the auxiliary chamber's external opening through an exhaust pipe which converts the chamber into a bottle water trap. A built-in detection sensor, an electronic control unit, and a solenoid valve manage the electric fan's operation and the bottle water trap's replenishment with water.

21 Claims, 9 Drawing Sheets

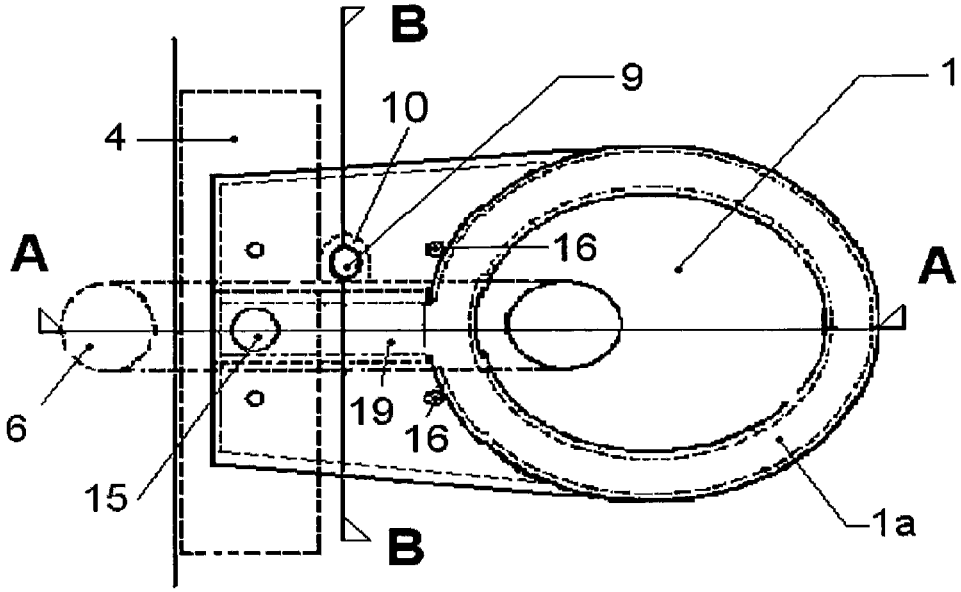
Fig. 3
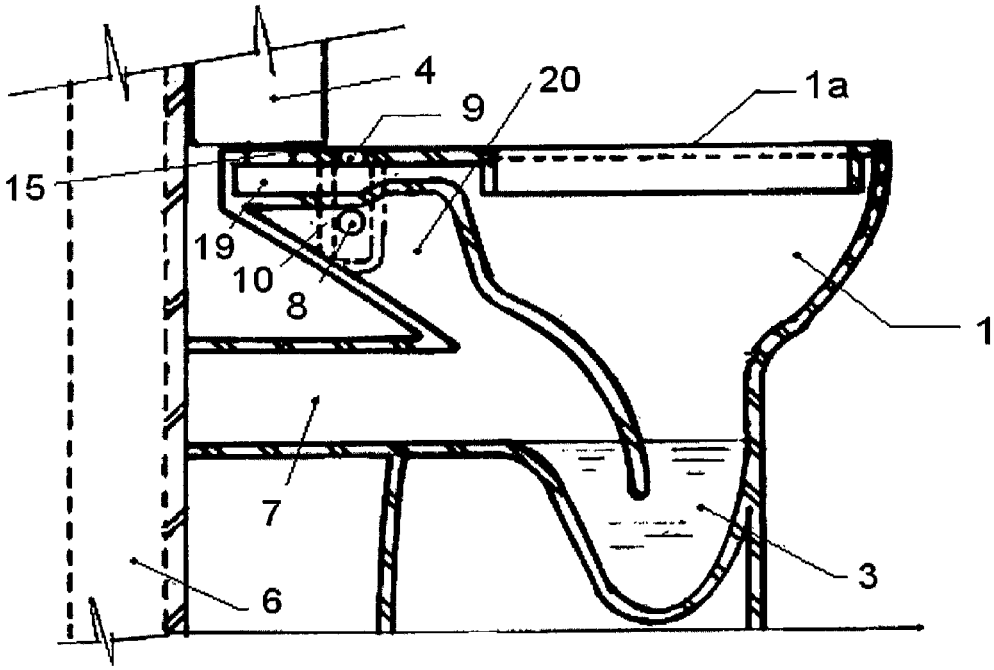
Fig 3A (section A-A)

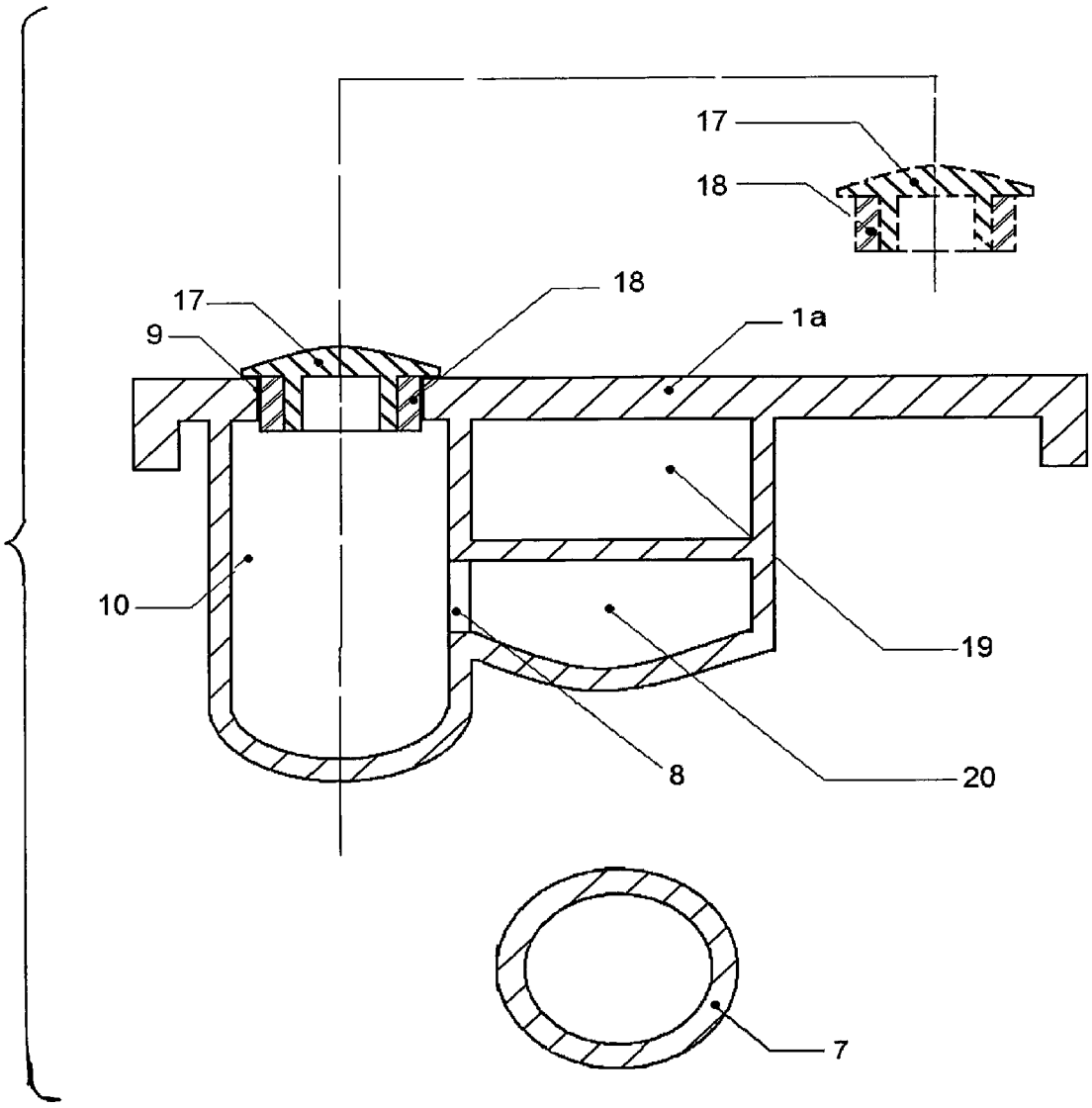
Fig. 3B (section B-B)

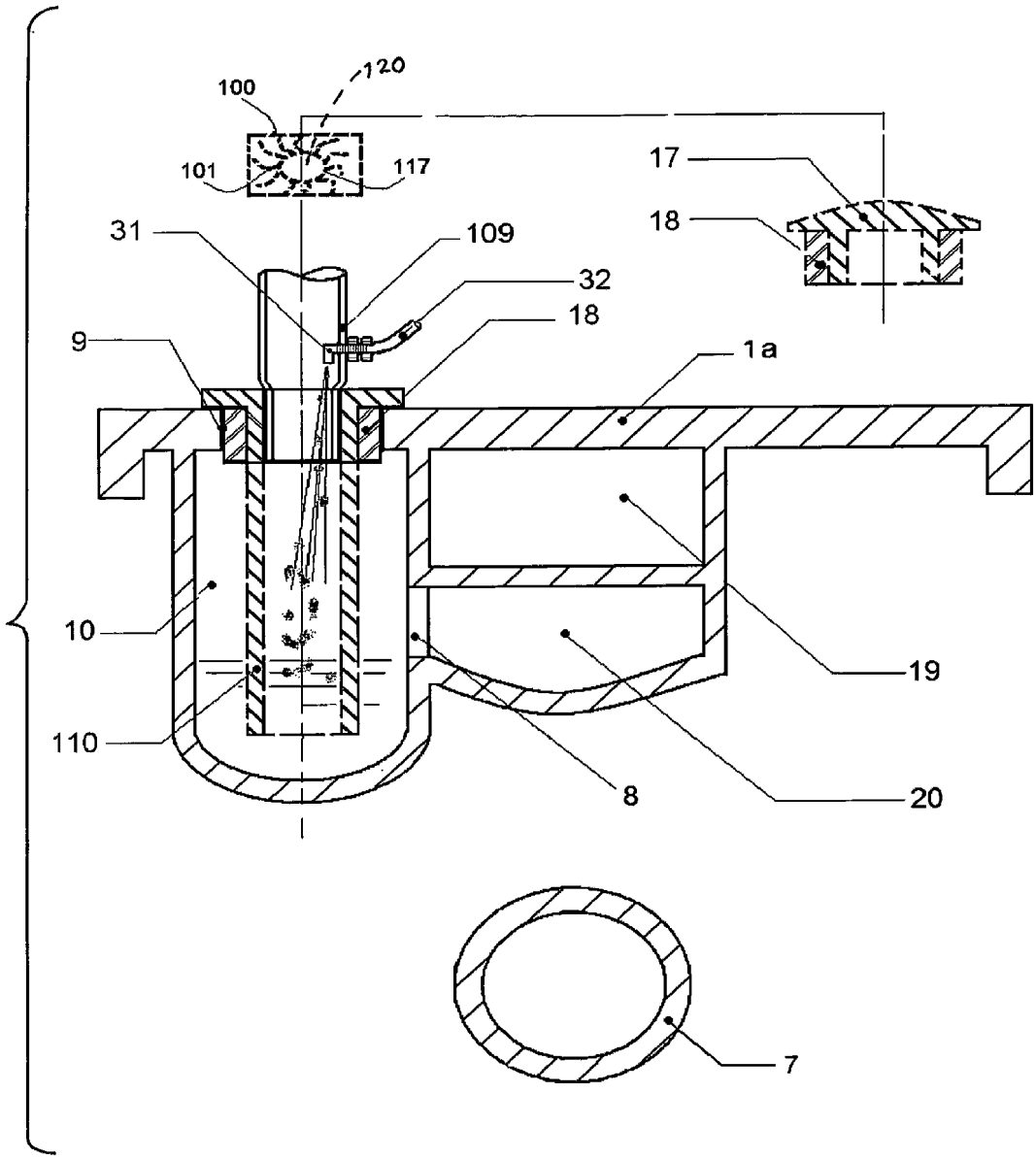
Fig.3C (section B-B)

SELF-VENTILATING TOILET

CROSS-REFERENCE TO RELATED APPLICATIONS

This is a continuation-in-part application of U.S. patent application Ser. No. 11/893,757, filed Aug. 17, 2007, now abandoned the disclosure of which is incorporated herein in its entirety by reference and made a part of this application.

BACKGROUND OF THE INVENTION

1. Field of the Invention

The history of the art of ventilating foul air from toilet rooms goes back to the time when domestic and communal toilet facilities were first introduced. Venting of malodors directly from toilet bowls before they pervade in toilet rooms had been tackled in recent years by many in different ways and to different degrees of practicability, but without any noticeable commercial success. The purpose of the invention described herein is to provide a versatile and reliable self-ventilating toilet bowl that is economical to produce; simple to install, operate and maintain; and comfortable and hygienic to the user.

2. Description of the Related Art

Direct venting systems of toilet bowls which use filtration and/or deodorizing of malodor and then re-circulating the treated gases into toilet rooms have been taught by many in the prior art. Such systems although accepted by some are known to cause allergies and discomfort to many people. Additionally, operation of such systems rely on replaceable consumable components, which require continuous financing and maintenance, and are an additional burden on the environment.

Systems whereby malodor is exhausted directly from the toilet bowl to the outside either through a special duct directed to a ceiling extraction fan, or through a special hole in the toilet wall or ceiling have also been taught by many. Although such methods can be efficient from a functional point of view, the installation of ventilation ducts inside tidy toilet rooms is considered an unsightly proposition which most people would decline. Ventilation ducts in some cases can be obstructive to the user or to the cleaner. Drilling holes for ventilation ducts in toilet room walls and ceilings in addition to being aesthetically damaging to buildings is generally not allowed in rented property or in apartment buildings.

Systems whereby malodor is vented directly from the toilet bowl and exhausted into the drainage system has been described in many previous patents and studies, but none was found to cover the numerous and important details which, without being addressed meticulously, would place limitations on the practicability, function, reliability or hygiene of such systems. This probably explains the lack of commercial success of these inventions.

The two most common approaches for ventilating toilet bowls directly is whereby malodors are sucked by an electric fan from the toilet bowl through a flat intake nozzle placed between the toilet rim and the toilet seat, or through holes and a cavity incorporated into the toilet seat itself. Practical testing of suction methods of malodor directly from toilet bowls by the inventor have confirmed that the single intake nozzle solution (even with a 24VA electric fan) is sufficient to achieve the necessary venting of the toilet bowl without causing discomfort to the user from excessive noise or irritating air drafts caused by high power electric fans, while maintaining adequate and efficient ventilation of the toilet bowl.

Suction through holes and a cavity in the toilet seat itself will also provide the necessary ventilation of the toilet bowl, but at an unjustifiably higher cost to the consumer. Such systems also incur technical difficulties at the toilet seat hinges with the suction and/or exhaust pipes which are normally addressed by the deployment of flexible piping or hollowed hinges which double up as exhaust pipes. Since hinges are subject to continuous movement during use and cleaning, both such solutions can lead to early deterioration of components, which will require maintenance or replacement of parts to avoid inefficient performance. For example, see Japan Patents JP 2004-209192 and JP 2005-163512, and U.S. Pat. Nos. 6,772,449; 6,795,980 and 7,103,925.

The use of the single nozzle intake method is also strewn with shortcomings if attention to detail is not meticulously observed. If the nozzle is not fixed to the toilet assembly, the use of such a system will be limited to domestic toilets, and even there might still be subject to mishandling. For example, see Japan Patent No. JP 2006-144519 and U.S. Pat. Nos. 6,948,192 and 6,550,072.

U.S. Pat. No. 6,499,150 to Thompson discloses a configuration whereby an air intake nozzle, an electric ventilation fan and a secondary siphon are deployed below the toilet rim level, thus exposing all components to flooding by contaminated water should the toilet bowl get clogged during flushing of the toilet bowl, especially while the ventilating air fan is on. Additionally the configuration of the above-mentioned ventilation components is unduly complicated to manufacture and difficult to access for cleaning and maintenance purposes.

Published US patent application No. US 2002/0002735 of Moon discloses direct ventilation from the toilet bowl into the drainage system, but relies on an unduly complicated one-way air flapper deployed inside the air fan's exhaust duct to prevent the backflow of gases from the drains. Although a one-way air flapper on its own may prevent the backflow of gases into the air fan, many country codes consider such measures insufficient to block the ingress of contaminating germs, and insist upon specifying fluid traps (i.e., siphons) for that purpose.

Another example of such attempts to ventilate toilet bowls is disclosed in published US patent application No. US 2006/0096013 of Dang, which discloses "bubbling" of the discharged gases through the water contained in the siphon on the drain's side inside the toilet bowl. The water in the siphon is made to block the backflow of contaminating gases from the drain. However, in this arrangement, excessive sounds emanating from the bubbling action inside the toilet bowl during the ventilation process, and the possible long-term contamination of the exhaust hose with dangerous germs that may be carried into the air fan from traces of feces deposited downstream of the siphon, place limitations on the practicability or hygienic qualities of the system.

SUMMARY OF THE INVENTION

The invention illustrated herein is a simple economical improvement to standard toilet bowls implemented during the manufacturing stage which provide the user with the option of a hygienic self ventilating toilet bowl without the shortcomings of the aforementioned systems.

The invention comprises a toilet commode whereby foul gases are sucked directly from the toilet bowl before spreading into the toilet room, and are discharged (via the toilet bowl itself) to the outside through the drain's vent, which is normally a part of all domestic and communal drainage systems, and is normally located at the highest point in the building.

The special feature comprises the integration into the toilet bowl of an auxiliary vertically placed elongated chamber with an opening at its top that communicates directly with an external circular opening disposed on the toilet bowl's rear rim's top surface behind the seat to one side of the flush water duct (causing no obstruction thereto), and with another opening in its upper side which connects directly with the inner chamber of the toilet bowl above and downstream of the siphon. The subject auxiliary elongated chamber and the two circular openings are incorporated homogeneously with the toilet bowl during the manufacturing stage without the introduction of any foreign material to the product. A special removable plug of suitable material, dimensions and color is provided to fit securely into the aforementioned external circular opening on the toilet bowl's rim behind the seat thus blocking it completely if the option of normal use of the toilet bowl (without the self ventilating feature) is required by the user.

The toilet bowl can be installed into any standard toilet room without the requirement of any special preparation, accessories or special expertise, apart from providing an electric socket close to the toilet bowl to power the ventilating pump.

If required by the owner, the self ventilating feature can be introduced to the toilet bowl, first by replacing the removable plug from the afore-mentioned external circular opening with a specially provided vertical duct which when fitted inside the auxiliary elongated chamber forms a secondary water siphon (bottle water trap), and second by retrofitting the following special air fan (i.e., pump).

The fan unit comprises a damp-proof, low-noise and low voltage electrical motor driven centrifugal (or other type) air fan contained within a water-proof and sturdy casing of a suitable size, material and color, with a circular suction inlet opening deployed near its front centre, and a discharge tube deployed at its upper tangent. The casing is fitted at its rear to the vertical part of a sturdy L-shaped plate base. The horizontal part of the plate fits below the toilet seat and is fixed to the toilet bowl at the toilet seat's anchor holes. Air suction from the toilet bowl is provided through a flat-shaped replaceable (for cleaning) nozzle deployed under the back of the toilet seat above and short of the rim of the toilet bowl. Exhaust is provided through a pipe outlet which connects securely at one end to the air fan's discharge tube, and at the other end to the special external circular opening in the toilet bowl. A biased (in the closed position) one way flapper and a mesh insect screen are deployed inside the exhaust duct to supplement a secondary siphon (described later) for the prevention of malodor, insects and germs from entering the air pump from the drains when the system is dormant.

The air pump is actuated through an optical or heat sensor deployed on the front face of the air fan casing. The sensor sends a signal to an electronic control unit deployed inside the air fan's casing to switch the electric fan on upon the approach of the user, and to switch it off a predetermined time after the user moves away.

Also deployed within the air fan casing, and managed by the integrated electronic control unit, is a solenoid water valve with an inlet connected through a flexible hose to the water supply tap (which is a standard toilet fitting and is normally located below the water flush tank), and to a downward pointing outlet nozzle deployed inside the vertical part of the air fan's exhaust duct beyond the one-way flapper and the insect screen.

The electric air fan causes gases within the toilet bowl to be sucked in through its inlet nozzle and out through its exhaust outlet. The vented gases cause the one way flapper inside the air fan's exhaust duct to be pushed into the open position, and the water in the secondary siphon (described in detail hereinbelow) to be drained through the internal side opening into the drain downstream of the primary siphon, thus opening the way for the vented gases into the drainage system and out through the drain's vent at the top of the building.

A pre-set time after receiving a signal from the air fan's sensor that the user has moved away from the toilet bowl, the electronic control unit turns the air fan off, and sends a signal to the water solenoid water valve to open up for a predetermined period to replenish the water in the secondary siphon (i.e., the auxiliary elongated chamber) which was drained away when the fan was actuated. The (biased) one-way flapper goes back to its normal closed position. Any backflow of gases or ingress of insects or contaminants from the drain into the air fan will be blocked by the combined action of the secondary siphon, mesh insect screen and flapper.

The versatility, simplicity and homogeneous construction of the toilet bowl, and the economic design and simplicity of the air pump makes manufacturing, installing/replacing, operating and recycling of both components simple, economical and environmentally friendly. The ventilation fan unit is fixed to the toilet commode and is therefore suitable for installation in domestic and public toilets, and does not require any consumable material or special servicing. There will be hardly any increased production cost over that of similar standard toilet bowls. The special features of the invention do not in any way impair or impede the function or the aesthetic looks of other standard components of the toilet room fixtures.

In summary, the present invention relates to a self-ventilating toilet bowl system, which comprises a toilet bowl made homogeneously of any suitable material and having an inner chamber and a rim, means to connect the inner chamber via a toilet siphon to a flush water supply, and means to connect the inner chamber to a drainage system. A generally vertical auxiliary elongated chamber extends below the rim to one side of the flush water duct, the auxiliary elongated chamber being open at the top, and having a second opening at its side which communicates directly into the inner chamber above and downstream of the toilet siphon and independent of the toilet siphon, the auxiliary elongated chamber containing a supply of water having a water level which extends up to the second opening. A low voltage motor driven suction air fan unit has a suction air fan and is positioned to the rear of the toilet bowl, the suction air fan unit including means for communicating with the inner chamber of the toilet bowl to draw gases thereto. Furthermore, the suction air fan unit includes means to direct gases removed from the toilet bowl to a generally elongated tubular member which extends into the auxiliary elongated chamber and below the water level in the auxiliary elongated chamber, to thereby form a water trap.

Finally, a water supply device is positioned and adapted to supply water to the water trap when the water level of the water trap falls below the bottom end of the tubular member.

When the gases drawn from the toilet bowl are directed through the water trap, they are forced through the water, causing the water level in the water trap to drain through the second side opening into the inner toilet chamber, thus requiring replenishment of the drained water by the water supply device when the air fan switches off.

Preferably the suction air fan is of the centrifugal type, and is contained within a casing of the suction air fan unit, the fan being attached to a detachable hollow intake nozzle device having a flat end of dimensions to fit between the toilet bowl rim and a toilet seat and being positionable between a plurality of toilet seat anchor holes, the other end of the intake nozzle device being generally circular to fit securely into the inlet opening of the suction air fan unit.

The centrifugal suction air fan unit is attached to a generally L-shaped plate, the plate having means for attachment to the toilet bowl behind the toilet seat. The second opening in the auxiliary elongated chamber is preferably generally circular, but can be of any shape and dimension, depending on the particular system used.

The centrifugal suction air fan unit further comprises an air flapper, biased in the closed position, the air flapper being positioned in a discharge tube for the suction air fan to prevent ingress of foul gases from the drainage system when the air fan is dormant. Further, an elbow duct connects the exhaust of the air fan to a discharge tube.

The centrifugal suction air fan unit further comprises a first straight duct connected at one end to the elbow duct, and at another end which fits inside the opening of the elongated auxiliary opening of the toilet bowl.

The centrifugal suction air fan unit further comprises a second straight duct connected with the first straight duct, with an integral external ring collar to limit penetration, and a rubber sleeve at the other end, fitting perfectly and firmly into the second elongated auxiliary chamber of the toilet bowl.

Preferably the centrifugal suction air fan unit further comprises a replaceable plastic mesh insect screen which fits securely into said second straight duct. The centrifugal suction air fan unit still further comprises an accessible waterproof manual electric switch which sends an "on" or "off" signal to a timing device connected to said suction air fan to time the operation of said suction air fan.

A waterproof pressure-sensitive electric switch fits under that toilet seat and sends an "on" or "off" signal to the timing device of the suction air fan according to the application or removal of the user's weight to and from said toilet seat. Alternatively, a motion-sensitive electric switch, or heat sensitive switch is integrated into the casing of the fan, which sends an "on" or "off" signal to the timing device of the suction air fan according to the approach or departure of the user.

The centrifugal suction air fan unit further comprises an integrated timing device connected to an electric switch and to an electric motor which drives the fan, which timing device is adapted to activate the motor upon receiving an "on" signal from said electric switch, and deactivates the motor approximately 30 seconds after receiving an "off" signal. Additionally, the centrifugal suction air fan unit further comprises a toilet seat cover shaped and dimensioned not to obstruct the detection of a user by said motion or heat sensitive switch when the seat cover is in the vertical position.

A first straight duct is provided, which incorporates on its inside wall, a downward pointing water nozzle, which connects on the outside to a water supply through a solenoid valve. The centrifugal suction air fan unit further comprises an electric solenoid water valve integrated into the suction air fan unit and controlled by a timing mechanism, the water valve being connected through a standard flexible hose to a water supply tap under the water tank, and its outlet being connected to the water nozzle.

The centrifugal air suction fan unit further comprises a second straight duct connected with the first straight duct, with an integral external ring collar to limit penetration, and a rubber sleeve approximately 25 mm in width, fitting perfectly and firmly into said auxiliary elongated chamber in the toilet bowl, and reaching to within about 10 mm from the bottom of the auxiliary air duct, to form the water bottle trap.

The centrifugal suction air fan unit further comprises an integrated timing device connected to the electric motor and to the solenoid valve, wherein the timing device activates the air fan upon receiving an "on" signal from an electric switch, and deactivates it about 30 seconds after receiving an "off" signal, said timing device then opens up a solenoid water valve for about 5 seconds, and then closes it.

The invention also comprises a replaceable plastic plug having a rounded top and a 25 mm-long shank and a rubber sleeve which is dimensioned and configured to fit perfectly and securely into the opening of the auxiliary elongated chamber when the toilet bowl is installed without said self-ventilating system feature.

A heat sensitive electric switch is alternatively integrated into the electric fan's casing which sends an "on" or "off" signal to the air fan's timing device according to the approach or departure of a user.

BRIEF DESCRIPTION OF THE DRAWINGS

The invention described herein is best described in conjunction with the following attached drawings and illustrations, wherein:

FIG. 3 is a top plan view of the improved toilet bowl of FIGS. 1 and 2, showing additionally, the toilet flush water tank and the flushing water duct;

FIG. 3A is an elevational and longitudinal cross-sectional view of the toilet bowl of FIG. 3, illustrating the integrated auxiliary elongated chamber and its two openings;

FIG. 3B is a lateral and elevational cross-sectional view taken along lines B-B of FIG. 3, of the auxiliary elongated chamber of FIG. 3, in relation to the adjoining components of the toilet bowl when used without the self-ventilating option;

FIG. 3C is a lateral and elevational cross-sectional view of the dedicated auxiliary elongated chamber in relation to the adjoining components of the toilet bowl when modified into a secondary siphon in combination with the suction air fan unit (i.e., pump);

DETAILED DESCRIPTION OF THE INVENTION

The invention illustrated herein discloses an improvement to standard toilet bowl designs, whereby ventilation is effected directly from the toilet bowl without the requirement of special preparations or installations inside the toilet room, or the use of consumable filters and/or deodorants.

Figure 1:
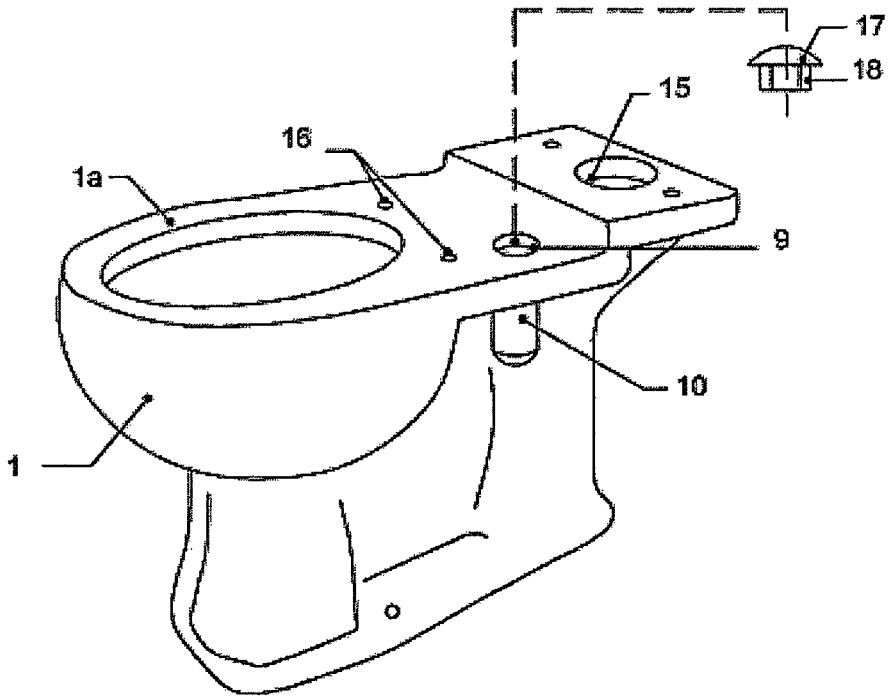
FIG. 1 is a diagrammatic perspective view of the improved toilet bowl with rim, flush water inlet, seat anchor holes, external circular opening on the upper rim behind the toilet seat, the specially supplied plug for blocking it if required, and the vertically placed elongated auxiliary chamber (secondary siphon) which opens directly to the inside of the toilet bowl above and downstream of the siphon.

With reference to FIG. 1, the apparatus of the invention consists of a toilet bowl 1 (pedestal or cantilever) made homogeneously of any suitable material (vitreous china, plastic, metal etc.) with standard rim 1*a*, seat anchor holes 16 and flush water inlet 15. A circular opening 9 in the toilet bowl top rear portion of the toilet rim is offset to one side (either left or right of flush water inlet 15) and opens up directly into a vertically placed auxiliary elongated chamber 10, which connects through an opening in its upper side directly to the inside of the toilet bowl above and downstream of the toilet primary siphon. A removable plug 17 of suitable size, material and color with rubber sleeve 18 fits securely into opening 9 thus blocking it completely during storage of the toilet bowl unit, or if the toilet bowl is to be installed without the self-ventilation feature.

Figure 2:
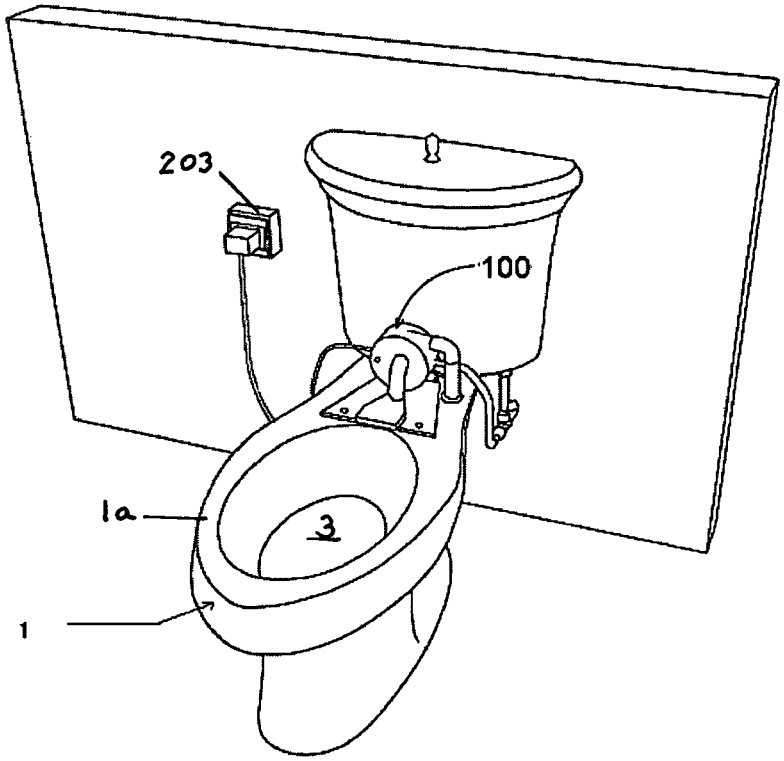
FIG. 2 is a diagrammatic perspective view of the improved toilet bowl of FIG. 1, with the ventilating air fan installed in place. The toilet seat and cover are omitted from the diagram to give a better view of the position of the air fan assembly unit.

FIG. 2 is a diagrammatic overall view of the toilet bowl system of the invention, with the ventilation suction air fan unit 100 installed in place. A toilet seat and cover which are standard toilet commode fittings are not shown in FIG. 2 to provide a clear presentation of the positioning of the suction air fan (i.e., pump) unit.

FIG. 3 is a plan view of the improved toilet bowl of the invention. The distance between the front face of flush water tank 4 and anchor holes 16 in the bowl rim 1*a* is sufficient to accommodate the installation of the specially specified electric air fan unit described hereinbelow. Circular opening 9 and auxiliary chamber (secondary siphon) 10 are deployed as such to avoid conflict with flush water duct 19, and to provide sufficient distance from water tank 4 for the installation of the electric air fan unit 100.

FIG. 3A is an elevational and longitudinal cross-sectional view of the toilet bowl of the invention, showing flush water duct 7, which connects with drain 6 of the main communal drain system. Auxiliary elongated chamber (secondary siphon) 10 extends sufficiently below the bottom of internal vent opening 8 to act as a secondary siphon (i.e., bottle water trap) in conjunction with the air fan fittings. Opening 8 which is preferably generally circular in auxiliary elongated chamber 10 opens directly into inner chamber 20 of toilet bowl 1 above and downstream of primary siphon 3.

FIG. 3B is a cross-sectional view taken across auxiliary elongated chamber 10 without the self ventilation feature, illustrating the components in the toilet bowl designed for accommodating the retrofitting of the ventilating suction air fan unit of the invention. Opening 9 of the auxiliary elongated chamber is securely blocked by specially-provided plug 17 and rubber sleeve 18, forming an airtight seal, thus preventing the ingress of any contamination from the drains into the toilet room.

FIG. 3C is a lateral and elevational cross-sectional view of the rear side of the toilet bowl with the self ventilation feature installed. Plug 17 of FIG. 3B is removed from opening 9 of auxiliary elongated chamber 10, and is replaced by vertical duct 110, which is of exact dimensions for an airtight fit into opening 9 through rubber sleeve 18. Preferably, vertical duct 110 reaches to within a few millimeters from the bottom of auxiliary elongated chamber (i.e., secondary siphon) 10. Gases which are vented into duct 110 through the outlet duct 109 of air fan 101 push the water at the bottom of water trap 10 (i.e., secondary siphon) upwardly through opening 8 into inner chamber 20 and inside the toilet downstream of primary siphon 3, thus opening the way for vented gases to escape to the outside via drain 6 to the air vent at the top of the building. Upon de-actuation of the air fan, water at the bottom of auxiliary elongated chamber 10 (i.e., secondary siphon) is replenished through a water supply tube 32 through a special water nozzle 31 deployed inside the exhaust duct 109 of air fan 101, to be described hereinbelow. Water thus introduced into secondary siphon 10 seals the siphon and forms a water trap which stops the ingress of contaminants from within the toilet bowl downstream of primary siphon 3 into the ventilation fan (pump).

Figure 4:
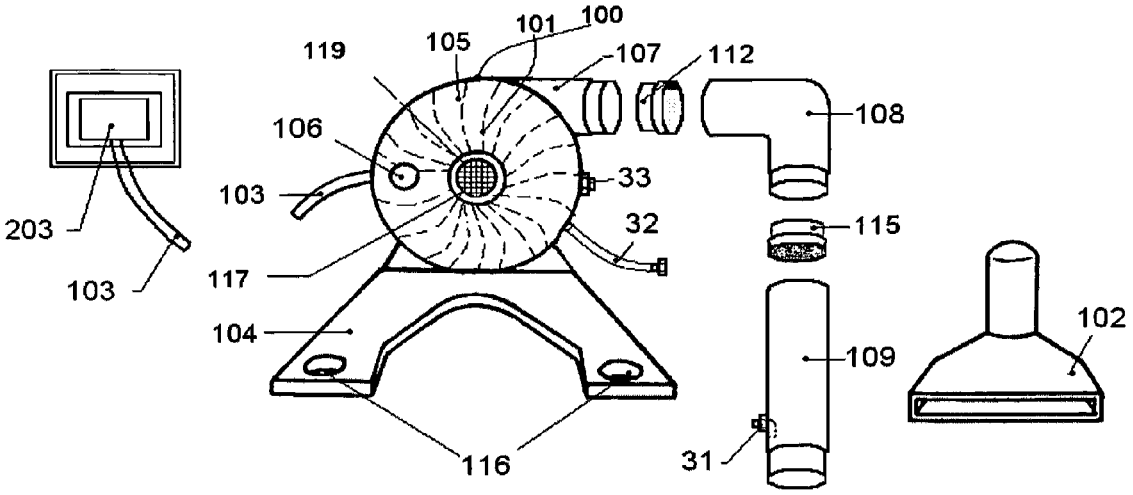
FIG. 4 is a diagrammatic perspective view of the ventilation suction air fan unit (i.e., pump) with the intake air nozzle and ventilation ducts detached, exposing external and internal components of the air fan unit for illustration purposes.
Figure 4A:
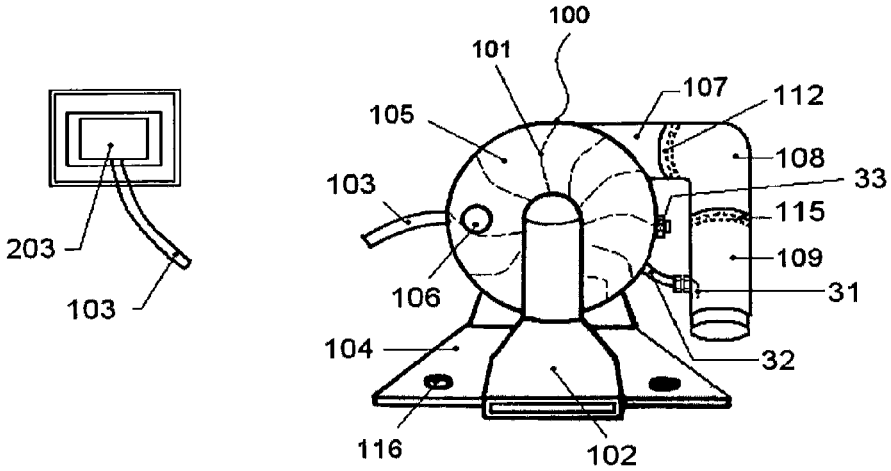
FIG. 4A is a diagrammatic perspective view of the suction air fan unit, with the air intake nozzle and exhaust ducts assembled.
Figure 4B:
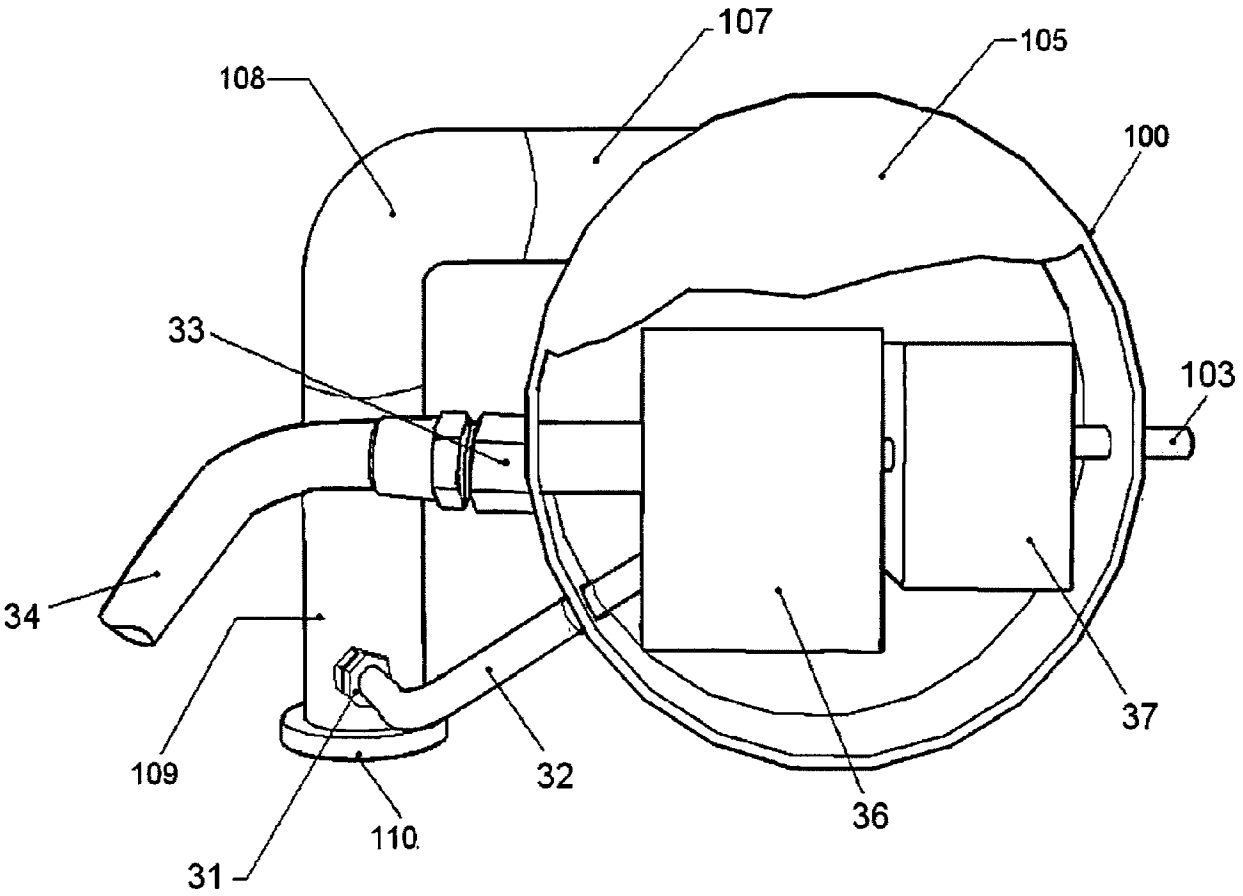
FIG. 4B is a rear elevational view of the inside of the air fan casing showing the internal rear components of the air fan.
Figure 5:
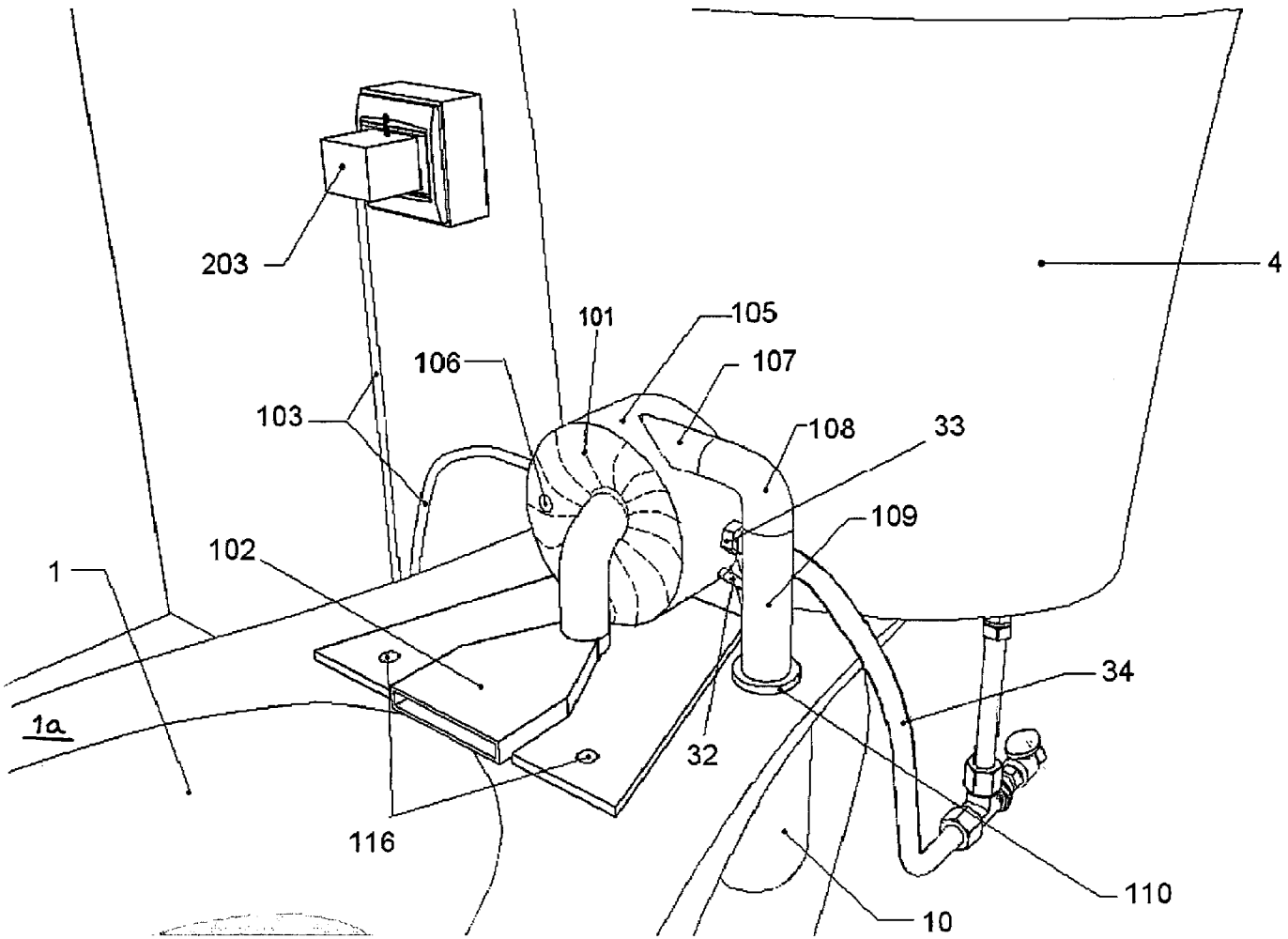
FIG. 5 is a diagrammatic perspective view of the suction air ventilating fan unit, retrofitted in place on the toilet bowl and showing its various external components and connections, the toilet seat and cover being omitted from the FIGS. for illustration purposes.
Figure 6:
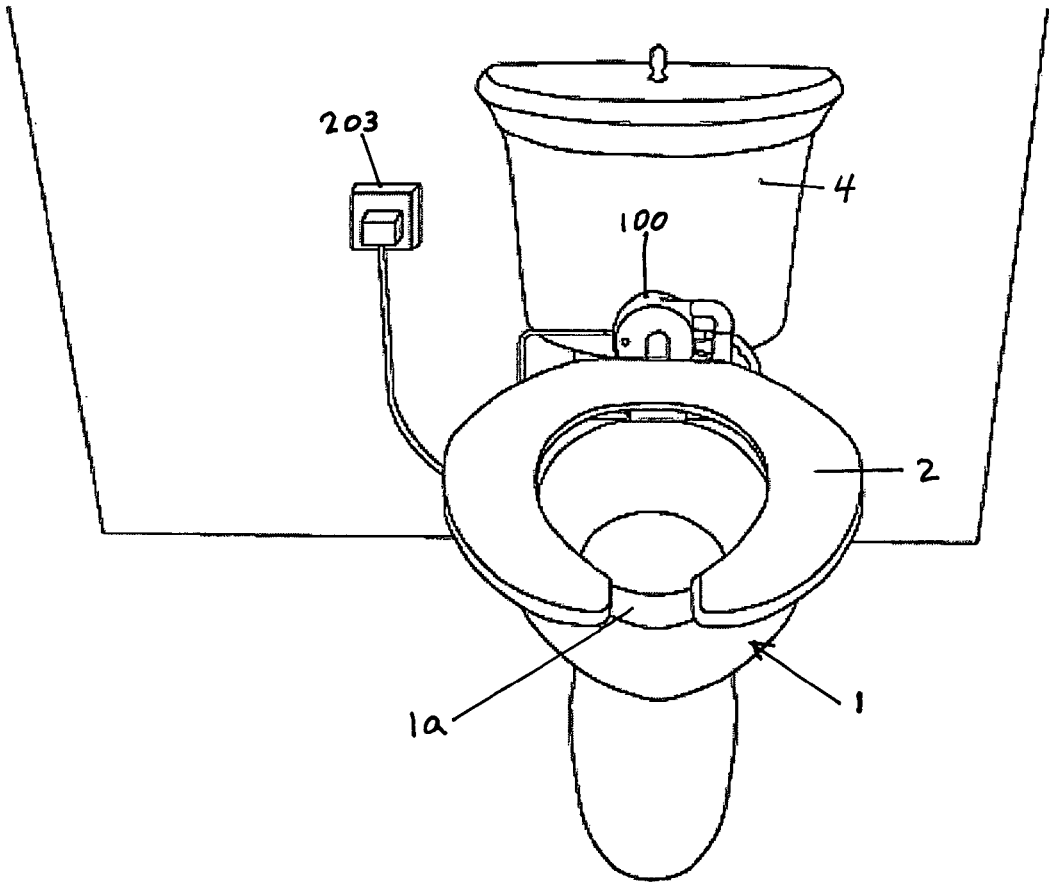
FIG. 6 is a diagrammatic perspective overall overview of the self-ventilating toilet system, with all retrofitted components assembled, the toilet seat cover shown in dash lines for illustration purposes only.

Illustrated in FIGS. 4, 4A and 4B is a low voltage (6-12V DC battery, or mains powered through transformer 203) electrically driven low-noise suction air fan (pump) assembly unit 100 which contains suction air fan 101 contained within a robust and waterproof hard casing 105 of suitable material, with a circular inlet opening 117 near its front centre. Discharge tube 107 is located at the upper tangent of casing 105, and an optical or heat sensor 106 is positioned on its front face. Suction air fan 101 is preferably of the centrifugal type, but may be of any alternative type. The air fan assembly unit 100 is of size and shape suitable to fit between the toilet seat anchor holes 16 and water tank 4 of the toilet system. A protective grating 119 is deployed at inlet opening 117 to protect the air fan impeller from accidental damage. Deployed behind the toilet seat is a detachable (for cleaning purposes) hollow air intake nozzle 102, of suitable shape and dimensions at its upper end to fit tightly onto inlet opening 117, and flat at the lower end as shown, to fit securely between toilet seat 2 and toilet bowl rim 1*a* of the toilet bowl 1.

Casing 105 of the suction air fan unit 100 is fitted firmly onto the vertical part of an L-shaped robust base plate 104 near its rear centre. The horizontal part of plate 104 is dimensioned and shaped to allow extra depth (the thickness of the plate) to the intake nozzle opening, thus providing better and quieter air suction from under the toilet seat. Two holes 116 at the front of the horizontal part of base plate 104 are deployed to overlap perfectly onto anchor holes 16 of the toilet bowl. Seat anchor bolts (not shown) are used to secure base plate 104 onto the rear rim of toilet bowl 1 under toilet seat 2. Exhaust outlet 107 is connected to pipe 110 (FIG. 3C), which is fitted into opening 9 in the toilet bowl, through elbow duct 108 and straight duct 109.

Deployed inside exhaust pipe 107 at its connection with elbow duct 108 is a replaceable one-way air flapper 112 which opens up only in the direction of the vented gases, and closes when gases flow in the opposite direction, or when the ventilation system is dormant (i.e., not ventilating). A replaceable mesh insect screen 115 is deployed inside elbow air duct 108 at its connection with vertical exhaust duct 109. Deployed inside air fan casing 105 is control unit 37, which is connected to sensor 106, to the air fan electric motor 120, and to solenoid water valve 36, shown in FIG. 4B. Solenoid water valve 36 is connected through flexible water hose 34 at its inlet 33 to the water supply tap (which is normally located in the wall under toilet water tank 4), and through flexible hose 32 to downward pointing water nozzle 31 deployed inside exhaust air duct 109.

Upon the approach of the user to the toilet seat, sensor 106 sends a signal to control unit 37 to switch the air fan on. Gases from toilet bowl 1 are sucked through ventilation intake nozzle 102, and are exhausted out through outlet 107. Flapper 112 is pushed by the outward flowing gases into the open position. Vented gases pass through elbow duct 108, into vertical exhaust duct 109, and into secondary water siphon pipe 110. Water contained in the bottom of secondary water siphon 10 is pushed by the vented gases through opening 8 into cavity 20 inside toilet bowl 1 downstream of primary water siphon 3, and out through drain 6, thus allowing the vented gases to escape to the outside through the drain's air vent at the top of the building.

When the user moves away from the toilet seat, sensor 106 sends a signal to control unit 37 to switch the electric air fan motor off after a predetermined time. When ventilation stops, control unit 37 sends a signal to water solenoid valve 36 to open up for a predetermined few seconds to allow water in through flexible hose 34 into inlet 33, and out through flexible hose 32 into nozzle 31 inside vertical exhaust duct 109, and into secondary siphon 10, thus replenishing the water which was pushed out into the drainage system upon the actuation of the air pump. Preferably, the supply of water in the secondary siphon of auxiliary elongated chamber 10 is replenished when the level of the water trap falls below the bottom end of vertical exhaust duct 109. Alternatively, any water level can be selected to initiate replenishment of the water supply in the water trap of secondary siphon 10.

Obstruction of sensor 106 is avoided by proper shaping (or removal) of the toilet seat cover (shown in dash lines for illustration purposes) to avoid the blocking of sensor 106 from the user.

The above illustrations and descriptions are not to be construed as limiting to the scope, spirit or details of the invention. Variations thereof, omissions therefrom or additions thereto can be made without departing from the spirit and scope of the invention.

The invention claimed is:

1. A self-ventilating toilet bowl system, which comprises:

a) a toilet bowl made homogeneously of any suitable material and having an inner chamber and a rim;

b) means to connect said inner chamber via a toilet siphon to a flush water supply;

c) means to connect said inner chamber to a drainage system;

d) a generally vertical auxiliary elongated chamber extending below said rim to one side of a flush water duct, said auxiliary elongated chamber being open at the top, and having a second opening at its side which communicates directly into said inner chamber of said toilet bowl, above and downstream of said toilet siphon and independent of said toilet siphon, said auxiliary elongated chamber containing a supply of water having a water level which extends up to said second opening;

e) a suction air fan unit having a suction air fan is positioned to the rear of said toilet bowl, said suction air fan unit including means for communicating with said inner chamber of said toilet bowl to draw gases thereto, said suction air fan unit further having means to direct gases removed from said toilet bowl to a generally elongated tubular member which extends into said auxiliary elongated chamber and below said water level in said auxiliary elongated chamber, to thereby form a water trap; and f) a water supply device positioned and adapted to supply water to said water trap when said water level of said water trap falls below the bottom end of said tubular member.

2. The self-ventilating toilet bowl system according to claim 1, wherein said suction air fan is centrifugal, and is contained within a casing of said suction air fan unit, said fan being attached to a detachable hollow intake nozzle device having a flat end of dimensions to fit between said toilet bowl rim and a toilet seat and being positionable between a plurality of toilet seat anchor holes, a opposite end of said intake nozzle device being generally circular to fit securely into an inlet opening of said air fan unit.

3. The self-ventilating toilet bowl system according to claim 2, wherein said centrifugal suction air fan unit is attached to a generally L-shaped plate, said plate having means for attachment to said toilet bowl behind said toilet seat, and said second opening in said auxiliary elongated chamber is generally circular.

4. The self-ventilating toilet bowl system according to claim 3, wherein said centrifugal suction air fan unit further comprises an air flapper, biased in the closed position, said air flapper positioned in a discharge tube for said suction air fan to prevent ingress of foul gases from said drainage system when said air fan is dormant.

5. The self-ventilating toilet bowl system according to claim 4, further comprising an elbow duct to connect the exhaust of said air fan to said discharge tube.

6. The self-ventilating toilet bowl system according to claim 5, wherein said centrifugal suction air fan unit further comprises a first straight duct connected at one end to said elbow duct, and at another end which fits inside the opening of said elongated auxiliary chamber of said toilet bowl.

7. The self-ventilating toilet bowl system according to claim 6, wherein said centrifugal suction air fan unit further comprises a second straight duct connected with said first straight duct, with an integral external ring collar to limit penetration, and a rubber sleeve at an opposite end of said second straight duck, fitting firmly into said elongated auxiliary chamber of said toilet bowl.

8. The self-ventilating toilet bowl system according to claim 7, wherein said centrifugal suction air fan unit further comprises a replaceable plastic mesh insect screen which fits securely into said second straight duct.

9. The self-ventilating toilet bowl system according to claim 8, wherein said centrifugal suction air fan unit further comprises an accessible waterproof manual electric switch which sends an "on" or "off" signal to a timing device connected to said suction air fan to time the operation of said suction air fan.

10. The self-ventilating toilet bowl system according to claim 8, wherein said centrifugal suction air fan unit further comprises a waterproof pressure-sensitive electric switch which fits under said toilet seat and sends an "on" or "off" signal to a timing device of said suction air fan according to a application or removal of the user's weight to and from said toilet seat.

11. The self-ventilating toilet bowl system according to claim 8, wherein said centrifugal suction air fan unit further comprises a motion-sensitive electric switch, or heat sensitive switch integrated into said casing of said fan, which sends an "on" or "off" signal to a timing device of said suction air fan according to an approach or departure of the user.

12. The self-ventilating toilet bowl system according to claim 8, wherein said centrifugal air suction fan unit further comprises an integrated timing device connected to an electric switch and to an electric motor which drives said fan, which timing device adapted to activate said motor upon receiving an "on" signal from said electric switch, and deactivates said motor approximately 30 seconds after receiving an "off" signal.

13. The self-ventilating toilet bowl system according to claim 12, wherein said centrifugal suction air fan unit further comprises a toilet seat cover shaped and dimensioned not to obstruct the detection of a user by said motion or heat sensitive switch when the seat cover is in a vertical position.

14. The self-ventilating toilet bowl system according to claim 13, wherein said centrifugal suction air fan unit further comprises said first straight duck which incorporates on its inside wall, a downward pointing water nozzle, which connects on an outside to a water supply through a solenoid valve.

15. The self-ventilating toilet bowl system according to claim 14, wherein said centrifugal suction air fan unit further comprises an electric solenoid water valve integrated into said air fan assembly and controlled by said timing mechanism, said water valve being connected through a standard flexible hose to a water supply tap under the water tank, and its outlet being connected to the water nozzle.

16. The self-ventilating toilet bowl system according to claim 15, wherein said rubber sleeve is approximately 25 mm in width and approximately 25 mm in width, said second straight duck reaching to within about 10 mm from the bottom of the auxiliary air duct, to form said water bottle trap.

17. The self-ventilating toilet bowl system according to claim 16, wherein said timing device activates said air fan upon receiving said 'on' signal from said electric switch, and deactivates it about 30 seconds after receiving said 'off' signal, said timing device then opens up said solenoid water valve for about 5 seconds, and then closes it.

18. The self-ventilating toilet bowl system according to claim 1, wherein a replaceable plastic plug having a rounded top and a 25 mm-long shank and a rubber sleeve is provided to fit securely into said opening of said auxiliary elongated chamber when said toilet bowl is installed without said self-ventilating system feature.

19. The self-ventilating toilet bowl system according to claim 1, wherein said centrifugal air suction fan unit further comprises a heat sensitive electric switch integrated into a casing of said suction air fan unit which sends an "on" or "off" signal to a timing device according to a approach or departure of a user.

20. A self-ventilating toilet bowl system, which comprises:

a) a toilet bowl made homogeneously of any suitable material and having an inner chamber and an upper rim;

b) means to connect said inner chamber of said toilet bowl via a toilet siphon to a flush water supply;

c) means to connect said inner chamber of said toilet bowl to a drainage system;

d) a generally vertical auxiliary elongated chamber extending through said rim and to one side of a flush water duct, said auxiliary elongated chamber being open at the top, and having a second generally circular opening at its side which communicates directly into said inner chamber above and downstream of said toilet siphon and independent of said toilet siphon, said auxiliary elongated chamber containing a supply of water having a water level which extends approximately up to said second opening;

e) a suction air fan unit having a suction air fan and being positioned behind said inner chamber, said suction air fan unit including a device for communicating with said inner chamber of said toilet bowl to draw gases from said inner chamber of said toilet bowl, said suction air fan unit further having means to direct gases removed from said inner chamber of said toilet bowl, to a generally elongated tubular member which extends into said auxiliary elongated chamber and below said water level in said auxiliary chamber, to thereby form a water trap; and f) a water supply device positioned and adapted to supply water to said water trap when the gases drawn from said inner chamber are directed through said water trap and into the drainage system, and said water level of said water trap falls below the bottom end of said generally elongated tubular member.

21. The self-ventilating toilet bowl system as defined in claim 20, wherein a replaceable plastic plug having a rounded top and a 25 mm-long shank and a rubber sleeve is provided to fit securely into said opening of said auxiliary elongated chamber when said toilet bowl is installed without said self-ventilating system feature.

* * * * *